US005364064A

United States Patent [19]

Carlson et al.

[11] Patent Number: 5,364,064

[45] Date of Patent: Nov. 15, 1994

[54] SAFETY SUB WITH ASYMMETRICAL WALL ELASTOMERIC CLOSURE FOR RETAINING DRILLING FLUIDS

[75] Inventors: Douglas W. Carlson; Stephen P. Simons, both of Kingwood, Tex.

[73] Assignee: Hydril Company, Houston, Tex.

[21] Appl. No.: 213,623

[22] Filed: Mar. 15, 1994

[51] Int. Cl.[5] ..... F16K 7/07

[52] U.S. Cl. ..... 251/5; 166/326

[58] Field of Search ..... 251/5; 166/321, 326; 175/218, 317, 324

[56] References Cited

U.S. PATENT DOCUMENTS

| | | | |
|---|---|---|---|
| 3,039,733 | 6/1962 | Mattioli | 251/5 |
| 4,111,391 | 9/1978 | Pilolla | 251/5 |
| 4,811,758 | 3/1989 | Piper . | |
| 5,165,493 | 11/1992 | Bargh | 251/5 X |
| 5,186,431 | 2/1993 | Tamari | 251/5 |
| 5,205,325 | 4/1993 | Piper . | |

OTHER PUBLICATIONS

National-Oilwell PS & PS2-500/500 Power Swivel, "Kick" Down Hole Pressure Control, Document No. 05-05-00, Undated.

National-Oilwell PS 500/500 & PS2 500/500 Power Swivel, Internal Blowout Preventer (IBOP) Assembly, Document No. 10-40-03, Undated.

*Primary Examiner*—John C. Fox

*Attorney, Agent, or Firm*—Vaden, Eichenroht, Thompson, Boulware & Feather

[57] ABSTRACT

A safety sub is disclosed for retaining drilling fluid in the kelly or equivalent and other components of the mud system located above the drill string when pressure drops in the drill string, such as when the circulation pump is turned off in adding a new joint to the drill string. The safety sub includes a pressurized elastomeric cartridge with an elastomeric closure having an asymmetrical wall thickness, preferably achieved by the removal of a chord of material from its external circumference. When internal drilling pressure drops, the external pre-charge pressure closes the elastomeric material by inwardly collapsing the thinner wall portion of the closure. The metallic end pieces of the cartridge are bonded to the elastomeric material during the molding process.

35 Claims, 3 Drawing Sheets

SAFETY SUB WITH ASYMMETRICAL WALL ELASTOMERIC CLOSURE FOR RETAINING DRILLING FLUIDS

BACKGROUND OF THE INVENTION

1. Field of the Invention

This invention pertains to retaining drilling fluid within the mud system of a drilling operation when there is a reduction or loss of pressure in the part of the mud circulating in the drill string or when the drill string is separated to add a new joint of pipe and specifically pertains to preventing spilling such fluid from the portion of the mud circulation system remaining in the part of the pipe assembly disconnected from the drill string when there is an addition of a new pipe joint.

2. Background of the Invention

A drilling operation of an oil or gas well generally involves a drill string with a drill bit attached to its lower end, a fluid system usually referred to as the "mud" system for lubricating the drill bit and for removing cutting debris from the well, and a drilling rig for supporting and rotating the drill string. The drill string is normally attached to the drilling rig component known as the "kelly", which is a longitudinal segment of drill stem that has a hexagonal or other discrete, multi-sided external surface for fitting into the central opening of the rotary table to allow the rotary table to rotate the kelly and, thus, the drill string attached and depending from it.

Each time that a new joint is added to the drill string, the drill string is separated from the kelly to allow the new connection to be made. The stand pipe from the mud system carries the drilling fluid to be circulated down through the drill string to a point above the kelly, which has been mentioned above is itself a rather long drill stem. When the connection is broken, unless provisions are made to include a "mud saver" valve of some sort, the drilling fluid or mud in the kelly is dumped onto the drilling rig floor, thereby causing a messy condition for the workmen, a possibly dangerous and hazardous condition, and creating an environmental spill that fouls the area. This occurs even though the drilling fluid circulation system itself is shut off because there is a great deal of the drilling fluid remaining in the kelly even when circulation is interrupted.

A sub outfitted with a mud-retaining device and referred to as a "mud saver" is known to have been employed in the prior art between the kelly and the drill string to prevent this dumping from happening. One such device that is in the marketplace is manufactured by National Oil Well. This sub incorporates a rubber tube of uniform wall thickness that collapses like a flattened hose to shut off mud flow. There is no internal supporting structure for the rubber tube, which fatigues rather rapidly and often fails to be satisfactory in retaining the drilling fluid even before failure of the hose because of the 180° bend of the tube. That is, when a thick rubber tube is folded back on itself there is an inherent opening at the ends of the bend that allows fluid to escape. Thus, an unsatisfactory amount of fluid can escape at either end of bend of the flattened tube. In addition, the bend causes the rubber to be greatly stressed, eventually resulting in failure. Large chunks often tear or break off when this sub is used and fall from the disconnected sub or down hole through the drill string once circulation of drilling fluid is restarted.

Another device incorporating a pressurized "mud saver" check valve on a drill string has been patented by Torus Equipment of Oklahoma City, Okla. in U.S. Pat. No. 4,811,758. This device incorporates a uniform wall elastomeric element that is pressurized from the outside, which pressure is overcome by internal drilling fluid pressure under normal drilling fluid conditions. When the drilling fluid pressure drops, such as preliminary to separating the drill string to add another joint, the external pressure on the elastomeric element causes some elastic action to occur, but mainly causes one end of the element to slide longitudinally to permit the element to close off the bore of the sub. The elastomeric element buckles from only one direction, as with the National Oil Well sub described above. Therefore, as the end moves up to allow the collapsing to take place, the elastomeric element closes in a manner that is determined by how the element naturally gathers or folds together. Repeated gathering operations in this manner show that the elastomeric element is quickly fatigued, resulting in the same tearing apart problems associated with the National Oil Well sub.

A fabric or cord reinforced collapsible sleeve of uniform wall dimension is employed in the flow control valve assembly disclosed in U.S. Pat. No. 5,205,325 assigned to Piper Oilfield Products, Inc. of Oklahoma City, Okla.

Yet another mud saver device incorporating a collapsible elastomeric element is disclosed in U.S. patent application Ser. No. 08/094,513, filed Jul. 20, 1993, commonly assigned with the present application. This element includes three area lobes of reduced wall thickness dimension located at evenly spaced locations around the periphery of the element. The device is similar to the device of the '758 patent in that the element is externally pressurized by a pressure that is overcome by normal internal drilling pressure during drilling operations, but that is sufficient to collapse the element when internal pressure is reduced or removed. The collapsing comes from the three directions of the thin-wall lobes. In such operation, the collapsing walls bunch up somewhat and touch each other leaving three partial openings between the resulting merging cusps that are the last portions of the overall opening to close as the closing pressure differential builds up. As noted in that disclosure, a relatively high pre-charge pressure of approximately 450 psi is required to completely close the opening of the element that is employed in its mud saver.

Therefore, it is a feature of the present invention to provide an improved safety sub for retaining drilling fluids above the sub in the event of reduction or loss of drilling fluid pressure.

It is another feature of the present invention to provide an improved safety sub of the type described above wherein the pressurized elastomeric cartridge is externally pressurized at a relatively low pressure to cause closing of a non-sliding, elastomeric element.

It is yet another feature of the present invention to provide an improved safety sub of the type described above having a pressurized elastomeric cartridge that includes a single thin-wall area that controllably and supportably collapses in an improved manner to minimize wear of the elastomeric element.

SUMMARY OF THE INVENTION

The safety sub for retaining drilling fluid in the external fluid supply above the drill string in the event of reduction or loss of normal operating fluid pressure in the drill string in accordance with the present invention includes an enlarged bore portion for retaining therein an externally pre-charged elastomeric cartridge of about 200 psi, the charge being less than the normal operating fluid pressure of the drilling fluid internal to the drill string. The cartridge includes a molded elastomeric closure portion with a central bore bonded to two metallic end pieces. The closure portion is essentially a cylinder with a single area of reduced wall dimension and it accepts a pneumatic pre-charge via a charge valve in the sidewall of the sub. At least one internal void in the sub surrounding the closure portion assures smooth closing and opening of the closure portion by acting as a pressure sump for the compressed air. The thin area of the wall is preferably achieved by eliminating a chord in the outer wall of the cylinder. O-rings in grooves of the metallic end inserts prevent leakage of the pre-charge, although there is leakage communication around the cartridge between the O-ring seals so that the pre-charge is applied approximately evenly to the outside surface of the elastomeric portion. In the event of loss or reduction of internal drilling fluid pressure, the pre-charge on the elastomeric cartridge causes the closure portion to close first at the thinnest or center portion of the reduced wall, which causes the opening to be divided into two smaller openings and then the elastomeric material rolls or waves along to efficiently close these two openings. The closing is, thus, not a mere folding over or bending as with one of the prior art structures described above and which is relatively inefficient and material fatiguing.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the drawings illustrate only preferred embodiments of the invention and are therefore not to be considered limiting of its scope as the invention may admit to other equally effective embodiments.

In the drawings.

DESCRIPTION OF THE PREFERRED EMBODIMENTS

Figure 1:
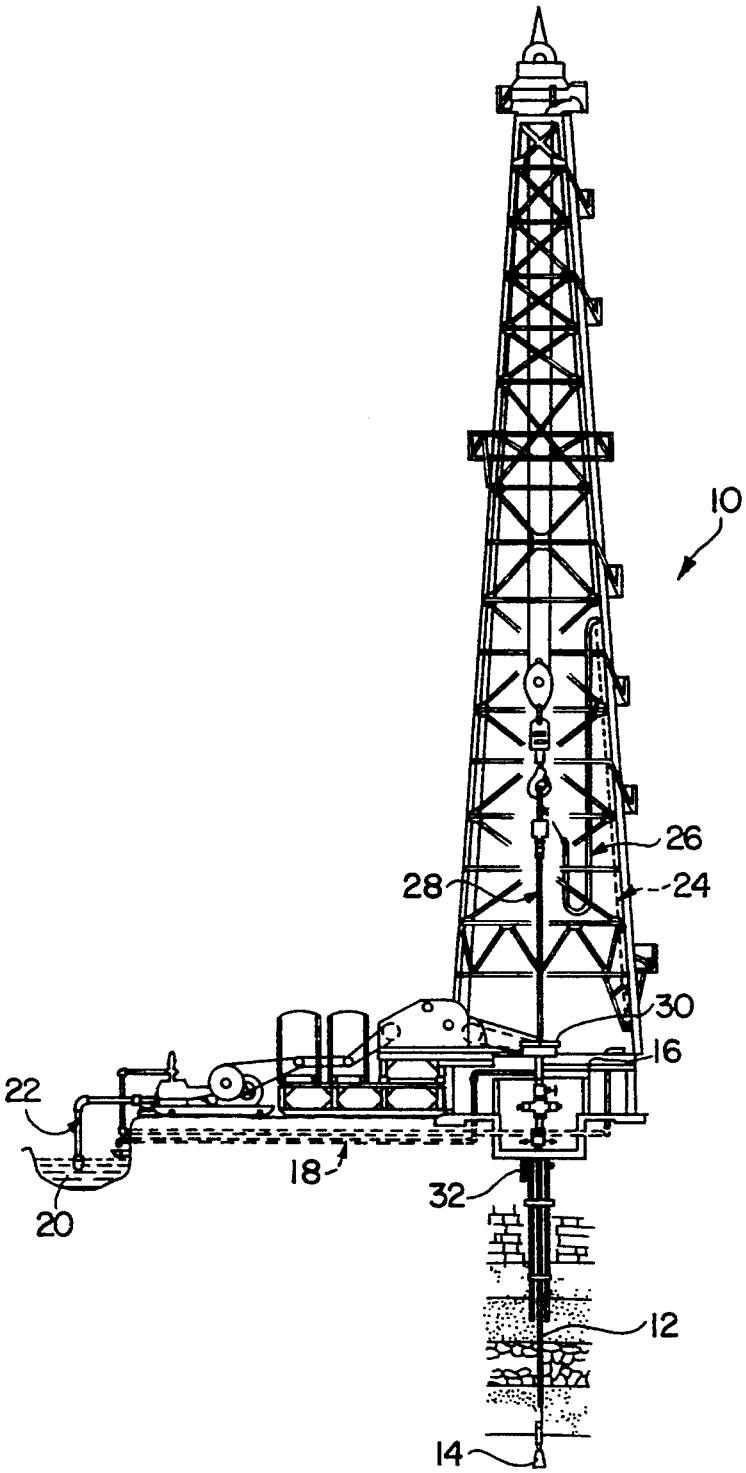
FIG. 1 is a plan view of a typical drilling installation in which a safety sub in accordance with the present invention can be used.

Now referring to the drawings, and first to FIG. 1, a typical drilling rig 10 is shown. The important operating components for understanding the operation of the present invention include drill pipe or drill string 12, which is made up of multiple joints of pipe connected end to end, the length of each joint typically being about 30 feet. The drill string supports bit 14 at its lower end and is hollow so that drilling fluid can be circulated down through the drill string to lubricate the cutting surfaces of the bit and to provide flushing or removal of cuttings and other debris up the annulus around the pipe. The effluent from the annulus is through flow nipple 16 to mud circulation system 18.

A reservoir 20 of the drilling fluid permits settling of the foreign matter from the fluid and treatment of the fluid with suitable additives. A suction pipe 22 leading from the reservoir permits suitable pumping of the fluid up through stand pipe 24 and rotary hose 26 to a location above the kelly or drill stem 28, an elongated hexagonal or octagonal pipe that leads down through the central opening in rotary table 30. Rotary table 30 closes on the kelly and is rotated to produce the turning or rotating forces on the drill string to cause drilling. A safety sub 32 in accordance with the present invention is included in the drill string between the upper joint of drill pipe and the kelly. In order to add a new joint of pipe to the string, the circulation system is stopped, the string is raised so that the lower end of the kelly and the safety sub to be described more fully hereinafter are positioned just above the rotary table to permit disconnection of the string from the safety sub. As soon as the pressure of the drilling fluid is reduced below a predetermined amount as determined by the counter or opposing pre-charge amount applied to the safety sub, as little as approximately 90–100 psi, the safety sub closes to prevent the fluid present in the kelly and the rotary hose and other components of the fluid circulation system located above the drill string from spilling or dumping out and not only making an environmental mess, but causing an unpleasant, slippery, possibly hazardous, and wasteful condition.

Once the new joint has been added to the drill string and circulation of the fluid restores the internal fluid pressure to operating conditions, the safety sub opens until the next time that fluid pressure in the drill string again is reduced.

It is noted that the drilling rig illustrated in FIG. 1 is a rotary drilling rig that includes a kelly and a rotary table. Many drilling rigs do not include these components. Instead, such rigs include a so-called top drive power swivel. The safety sub described herein can be employed in such a rig by being connected directly to the power swivel in the same manner as it is connected to the kelly in FIG. 1.

Figure 2:
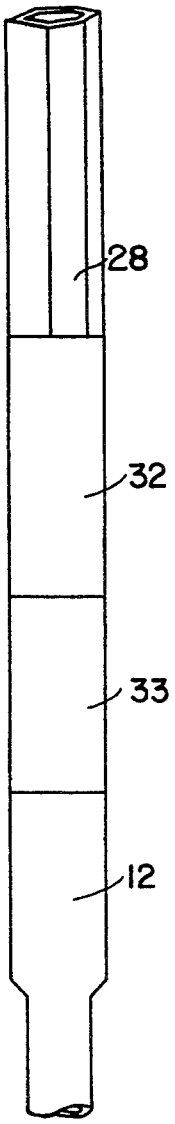
FIG. 2 is a fragmentary side view of a portion of a rotating drill string in a rotary drilling rig illustrating the location of the safety sub in accordance with the present invention.

Now referring to FIG. 2, a closer view of the operation just described is illustrated. The bottom of kelly 28 is connected to the top end of safety sub 32. A manually controlled drill stem ball valve sub 33 or the strippable kelly cock is connected to the lower end of sub 32 for positively shutting off the fluid when there is a requirement to have independent control of this function and not merely rely on the automatic shut-off associated with the safety sub alone. Finally, the ball valve sub is connected into the box end of the upper drill pipe of drill string 12. In any particular rig, there may be additional subs or a variation from what has been shown.

Figure 3:
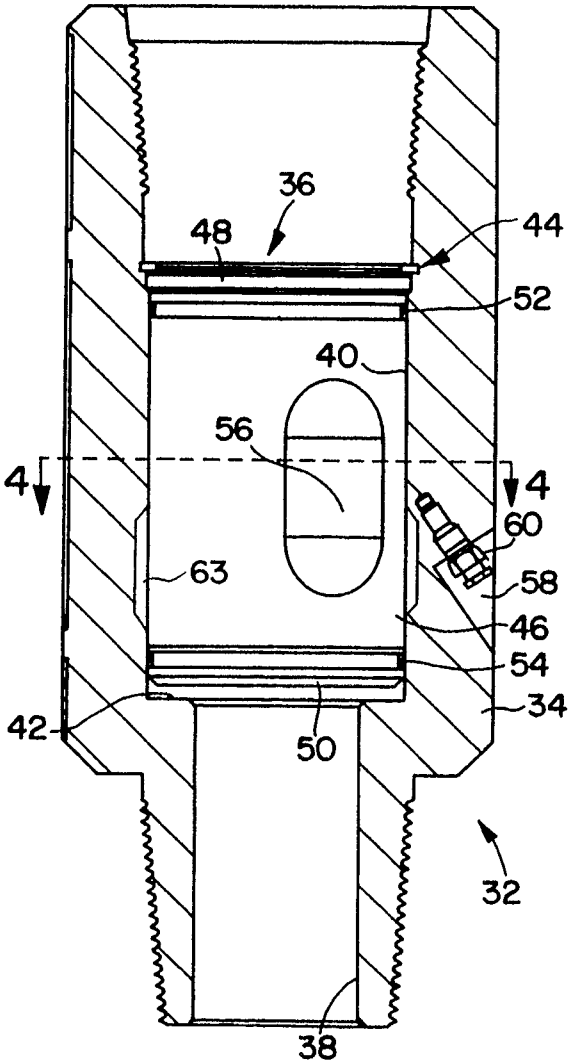
FIG. 3 is a longitudinal cross-sectional view of the drill stem sub portion of the safety sub in accordance with a preferred embodiment of the invention, showing the elastomeric cross-section in open view.

Safety sub 32 shown in FIG. 3 includes an outer drill stem sub section 34 and an internal elastomeric cartridge 36. Sub section 34 is externally threaded at its lower end for connection to the top joint of the drill string and includes a central bore 38, which is sized to be consistent or approximately the same as the central bore of the drill string. Central bore 40 in the middle of sub section 34 is enlarged with respect to bore 38, thereby forming an internal lip or ledge 42 for limiting the downward movement of cartridge 36. An internal groove in central bore 40 receives a snap ring 44 for retaining cartridge 36 in central bore 40. At the upper end of sub section 34, the bore is internally threaded for connection to the kelly, as previously described.

As will be explained more in detail below, the elastomeric cartridge is comprised of a molded central closure portion or element 46, an upper metallic end piece 48 and a lower metallic end piece 50. These metallic end pieces are each peripherally grooved to receive an O-ring 52 and 54, respectively, for sealing against gas leaks with respect to the inside surface of central bore 40.

The molded central closure portion 46 of cartridge 36 is essentially cylindrical between the metallic end pieces and includes a single external depression 56 covering approximately two-thirds or more of the length of the cylinder. As shown in a longitudinal cross-sectional side view of the cartridge and closure, depression 56 is scooped out so that the side wall of the closure is gradually thinner as it progresses to its thinnest part in the center of the depressed area, the area gradually sloping to the normal thick wall dimension at the top and bottom. As shown in FIG. 3, the top and bottom parts of the depressed area are domed shaped. Finally, as shown in the lateral cross sectional view of FIG. 4, depression 56 is formed by the removal of a chord of material from its outside surface so that the thinnest wall dimension at the center of the depressed area is about three-fourths that of the normal wall thickness. A wall thickness range of thinnest to normal of 50–90 percent is acceptable. The dimensions of a preferred embodiment of a closure portion 46 has a thin section width of 1.65" length of 4.65", thick wall of 0.875" and thin wall of 0.675", which provides a ratio of thin wall to thick wall of 0.675/0.875, which is to equal 0.77. The length of the depression is very near the entire length of the cylinder between the metallic end pieces. The elastomeric closure material for the preferred embodiment has an elongation capability greater than 250% (preferred range of 250–700%); a tensile set of less than about 17% (preferred range of 3–20%); and a modulus greater than 800 psi (preferred range of 700–2700 psi).

Figure 4:
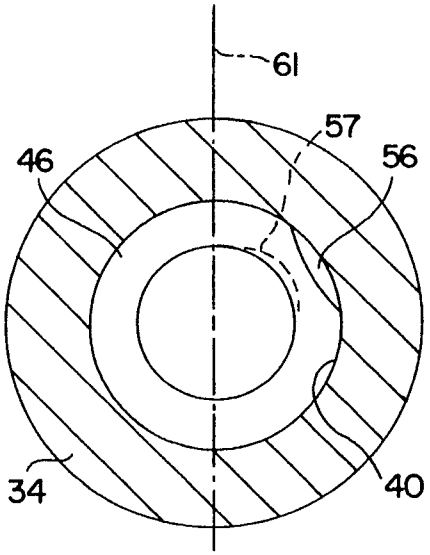
FIG. 4 is a lateral cross-sectional view taken at line 4—4 shown in FIGS. 3 and 6.

The sidewall of sub section 34 includes an external recess 58 for receiving in a fixed location, such as by a threaded connection, charge valve 60. The recess is deep enough so that no part of the valve is beyond the external surface of sub section 34. The valve is positioned at a convenient access angle to longitudinal axis 61 of the sub section and its exit end is open to central bore 40. The preferably offset angle from depression 56, as shown by axis 61 in FIG. 4, is about 45°, although 30°–90° is acceptable, any angle being operable. Before being put into operation, the external surface of the elastomeric cartridge is pre-charged to an amount sufficient to cause the cartridge to seal off the bore with the circulation pressure having been cut off. Ordinarily, this pre-charge is about 90–100 psi, which is much less than the over 200 psi required for prior art structures. It is convenient to use an inert gas such as nitrogen for pre-charging or pressurizing the safety sub, although clean air can be used, if desired. A valve suitable for performing in the manner described is a Schrader loading valve or its equivalent. A void 63 exists around inside central bore 40 of sub section 34, which may be longitudinally displaced from the discharge location of charge valve 60. This void functions as a sump for smoothing out the collapsing of closure portion 46, as hereafter described, and the opening thereof when internal bore pressure is restored. Enough leakage communication exists around central closure 46 between gas-tight sealing O-ring seals 52 and 54, including at void 63, that there is equal inwardly directed radial pressure applied to the external surface of closure portion 46.

It is noted that void 63 is preferably only one depression void around the entire internal surface of sub section 34. However, there can be discontinuous depressions or multiple depressions instead, as desired.

Void 63 provides a sump for the gas used in precharging the system. The ratio of the volume of gas in void 63 when the closure element is fully open, as shown in FIG. 3, to the volume of gas between the closed element and the inside of cartridge 36 between O-rings 52 and 54 is about 1-to-6. The ratio could be as little as 1-to-2 and operate substantially the same. Although it is preferable that void 63 be displaced longitudinally slightly from the outlet end of pre-charge valve 60, it is acceptable for the discharge end of valve to be in void 63.

Figure 5:
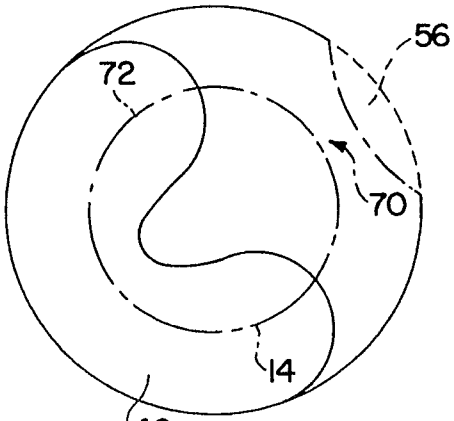
FIG. 5 is a lateral cross-sectional view of the elastomeric portion of the safety sub shown in FIG. 3 with the portion fully collapsed.

Turning to FIG. 5, central closure portion or element 46 of cartridge 36 is shown in its collapsed state. The dotted section of the drawing illustrates the pre-collapsed condition of the closure element. The thinnest wall dimension of the closure element, which is essentially a tube with a notch taken out of one corner at depression 56, is at center 70 of this depression. Thus, when the pressure differential on the outside of element 46 is greater than on the inside to cause the element to collapse, the element first collapses at center 70. Since the elastomeric material of element 46 is relatively homogeneous and universally resilient, further collapsing results in the material rolling outwardly from the initial point of contact with the opposite wall of the thinnest wall area at center 70. As it rolls or waves outwardly towards ends 72 and 74 of the previous opening, the material effectively applies an ever-increasing amount of pressure of relatively soft and flexible material to completely close or shut off the remaining openings at ends 72 and 74 with a surprisingly relatively low amount of pressure compared with the amount to close the closure openings of a tube having uniform wall dimension. That is, the tube does not just fold back on itself as with a uniform tube, which requires a relatively high amount of pressure differential to completely close or pinch off the folded-back ends of the opening.

Figure 6:
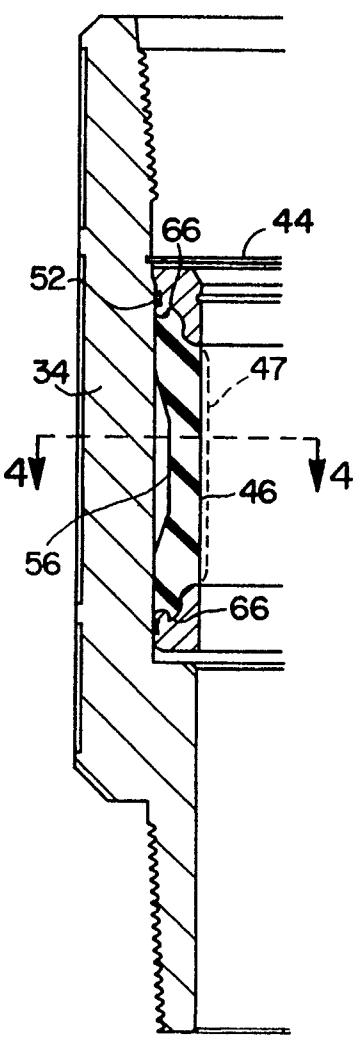
FIG. 6 is a longitudinal cross-sectional view of the elastomeric cartridge of the safety sub shown in FIG. 3, disclosing the shape of the metallic end inserts and the elastomeric closure.

A preferred embodiment of the cartridge is shown in FIG. 6, where it can be seen that in addition to being a tapered conical surface, the insertion end of the metallic inserts includes an interlocking shape 66 to maximize bonding thereof with the material of closure element 46.

It should be noted that the elastomeric material performs the entire closing and opening operation by its elastomeric properties alone and without movement of an end to the cartridge. In order to operate in such fashion, the material that is employed possesses high elongation properties, has high tensile strength with the ability to rapidly dissipate energy, is highly resistant to flexure fatigue, and has a sufficiently high modulus to provide dimensional stability to the structure. Among the materials that possess these properties and are acceptable for the purposes described herein are nitrile, chloroprene and natural rubber. Other important characteristics that are desirable for the elastomeric material include resistance to oil and water contamination or degradation and to the other ingredients found in drilling fluids and retention of its desirable mechanical properties set forth above over a broad range of operating temperatures. Because resistance to both oil and water is such an important consideration in the application of the invention described herein, nitrile and chloroprene elastomers are preferred materials for the elastomeric closure employed in the cartridge. An elastomer for the application described herein is characterized more specifically by these properties: hardness in Shore A units, 60–90; modulus, 700–2700 psi; ultimate elongation, 250–700%; and tensile set, 2–20%.

The central bore of the elastomeric cartridge can be cylindrical. However, it has been found that there is an advantage to the internal bore 45 being slightly hourglass shaped as shown at shape 47 in FIG. 6 to minimize the stresses in the rubber as the thin wall inwardly flexes to and from the closed position as discussed above.

In operation, when the internal pressure in the central bore of the elastomeric closure reduces to an amount that allows the pre-charge external pressure to act, a cusp is formed opposite the depression. More specifically from the beginning, when a depressurized safety sub is charged with the precharge pressure, the elastomer stretches inwardly primarily at the cusp. This stretching continues until the central bore opening is sealed off in the manner described above.

It should be noted that by depressurizing the safety sub, the elastomeric material of central closure 46 relaxes and provides a fully opened bore therethrough for accommodating a survey tool or the like. There are no irregularities of this substantially circular bore.

Figure 7:
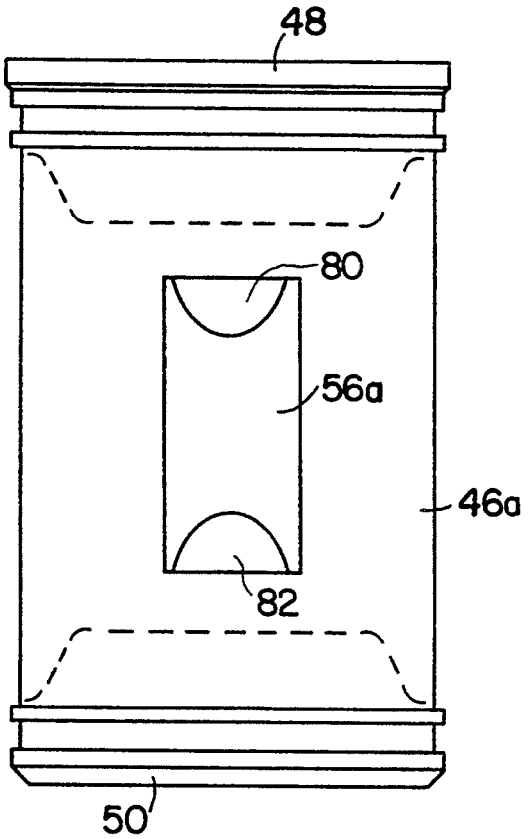
FIG. 7 is a side view of the elastomeric portion of an elastomeric cartridge in accordance with the present invention.

Another embodiment of the invention is shown in FIG. 7. This embodiment illustrates metallic end pieces 48 and 50 bonded to a closure element 46*a*, which is identical in every way to closure element 56, except that depression 56*a* in the outside wall of the element is shaped a little differently from the shape of depression 56 shown in FIG. 3. In this case, the depression is substantially rectangular, with the ends of the depression thickening at portions 80 and 82 in reverse dome-shaped planes that focus the applied external pressure to the depression a little more definitively than for depression 56.

It is also possible to provide a thin wall depression in the internal bore of the closure element, rather than in the external wall, or in both the internal wall and the external wall thereopposite, if desired. Moreover, although it appears from FIGS. 3 and 4 that the thinner area of the wall of closure element 46 is only over about 75° of the circumference, the thinner area is operationally successful over a range of about 30°–330°. If a larger arc of material was removed than that shown, the removal would have to be by a removal of something other than a chord, however. A range of less than 45°–160° is preferred for the thinner portion of the wall.

Also, even though two preferred embodiments of the overall configuration of the depression are specifically illustrated, 56 in FIG. 3 and 56*a* in FIG. 7, other contours or configurations of the depression are also acceptable.

While several embodiments of the invention have been described, it will be understood that the invention is not limited thereto, since many modifications in addition to those specifically discussed may be made and will become apparent to those skilled in the art. For example, the wall thickness of the closure element can be made asymmetrically thinner to function in accordance with the above description by removal of material from the internal bore of closure 46, such as shown by removal area 57 in FIG. 4, or, if preferred, by the removal of material from both the internal wall of closure 46 and the external wall of closure 46 thereopposite, again as shown in FIG. 4 when area 57 and depression 56 are considered together.

What is claimed is:

1. A safety sub for retaining drilling fluid in the external fluid supply above a drill string in the event of reduction or loss in operating fluid pressure in the drill string, comprising an elastomeric cartridge having a longitudinal axis, including a molded elastomeric central closure and two metallic end pieces longitudinally fixedly connected to the respective ends of said molded closure, said elastomeric cartridge having a central bore sized consistently in internal diameter with the size of the internal bore of the drill string, a receiving drill stem sub connectable at its upper end to the external fluid supply and at its lower end to the pressurized drill string, said drill stem sub having an internal central bore sized consistently with the size of the internal bore of the drill string, the drill stem sub central bore including an enlarged portion suitable for receiving in a fixed location therein said elastomeric cartridge, the wall of said elastomeric closure having an area on one side that is substantially thinner in dimension than the remainder of the wall along a substantial length of said closure, and a charge valve in the side of said drill stem sub for pneumatically pre-charging said elastomeric cartridge at a level less than the operating fluid pressure in the drill string so that normal operating fluid pressure maintains open the central bore of said elastomeric cartridge and fluid pressure less than normal operating fluid pressure results in the pneumatic pre-charge closing of said elastomeric cartridge by inwardly collapsing said thinner area of said elastomeric closure to prevent further drill fluid flow from the external fluid supply until normal operating fluid pressure is restored in the drill string.

2. A safety sub in accordance with claim 1, wherein said thinner area covers a circumferential range of between 45° and 160°.

3. A safety sub in accordance with claim 1, wherein said thinner area is achieved by reducing the external diameter of said elastomeric closure in the vicinity of said thinner area while maintaining constant the internal bore diameter.

4. A safety sub in accordance with claim 3, wherein the external diameter of said elastomeric closure is reduced by the effective removal of a chord of material from the external surface of said closure.

5. A safety sub in accordance with claim 1, wherein said thinner area is achieved by reducing the internal diameter of said elastomeric closure in the vicinity of said thinner area.

6. A safety sub in accordance with claim 1, wherein said thinner area is achieved by reducing both the internal and external diameters of said elastomeric closure in the vicinity of said thinner area.

7. A safety sub in accordance with claim 1, wherein the wall thickness of said thinner area is not uniform by being its thinnest near its center.

8. A safety sub in accordance with claim 1, wherein said charge valve is circumferentially aligned away from said thinner area of said elastomeric closure.

9. A safety sub in accordance with claim 8, wherein said charge valve is circumferentially aligned within 90° of said thinner area of said elastomeric closure.

10. A safety sub in accordance with claim 1, and including sealing means between each of said metallic end pieces and the enlarged portion of the internal central bore of said drill stem sub for retaining the pneumatic pre-charge from discharging.

11. A safety sub in accordance with claim 1, wherein said charge valve pre-charges said elastomeric cartridge over a range of 90–100 psi.

12. A safety sub in accordance with claim 1, wherein the internal wall of said elastomeric cartridge between said two metallic end pieces includes a void at least partially surrounding said elastomeric closure.

13. A safety sub in accordance with claim 12, where the volume of the void is in the range of 1/6 to ½ of the volume between said end pieces outside of said elastomeric closure when it is collapsed added to the volume of said void.

14. A safety sub in accordance with claim 1, and including a retainer means for longitudinally retaining said elastomeric cartridge within said drill stem sub.

15. A safety sub in accordance with claim 1, wherein the central bore of said elastomeric cartridge is cylindrical.

16. A safety sub in accordance with claim 1, wherein the central bore of said elastomeric cartridge is hour-glass shaped.

17. A safety sub in accordance with claim is wherein the receiving ends of said elastomeric closure and the insertion ends of said two metallic end pieces are respectively matingly conically tapered.

18. A safety sub in accordance with claim 17, wherein the respective conically tapered ends of said elastomeric closure and said metallic pieces include interlocking grooves.

19. A safety sub in accordance with claim 18, wherein said elastomeric closure is made of material having an elongation capability of 250–700%, a tensile set of 2–20% and a modulus of 700–2700 psi.

20. An elastomeric cartridge subassembly for insertion into an enlarged bore portion of a receiving drill stem sub to form a safety sub for retaining drilling fluid in the external fluid supply above a drill string in the event of reduction or loss in operating fluid pressure in the drill string, said elastomeric cartridge comprising a molded elastomeric central closure having a central bore sized approximately equal in internal diameter with the size of the internal bore of the drill string, the wall of said elastomeric closure having an area on one side that is substantially thinner in dimension than the remainder of the wall along a substantial length of said closure, and two metallic end pieces longitudinally fixedly connected to the respective ends of said molded closure.

21. An elastomeric cartridge subassembly in accordance with claim 20, wherein said thinner area covers a circumferential range of between 45° and 160°.

22. An elastomeric cartridge subassembly in accordance with claim 20, wherein said thinner area is achieved by reducing the external diameter of said elastomeric closure in the vicinity of said thinner area while maintaining constant the internal bore diameter.

23. An elastomeric cartridge subassembly in accordance with claim 22, wherein the external diameter of said elastomeric closure is reduced by the effective removal of a chord of material from the external surface of said closure.

24. An elastomeric cartridge subassembly in accordance with claim 20, wherein said thinner area is achieved by reducing the internal diameter of said elastomeric closure in the vicinity of said thinner area.

25. An elastomeric cartridge subassembly in accordance with claim 20, wherein said thinner area is achieved by reducing both the internal and external diameters of said elastomeric closure in the vicinity of said thinner area.

26. An elastomeric cartridge subassembly in accordance with claim 20, wherein the wall thickness of said thinner area is not uniform by being its thinnest near its center.

27. An elastomeric cartridge subassembly in accordance with claim 20, wherein said charge valve is circumferentially aligned away from said thinner area of said elastomeric closure.

28. An elastomeric cartridge subassembly in accordance with claim 27, wherein said charge valve is circumferentially aligned within 90° of said thinner area of said elastomeric closure.

29. An elastomeric cartridge subassembly in accordance with claim 20, and including sealing means between each of said metallic end pieces and the enlarged portion of the internal central bore of said drill stem sub for retaining the pneumatic pre-charge from discharging.

30. An elastomeric cartridge subassembly in accordance with claim 20, and including a retainer means for longitudinally retaining said elastomeric cartridge within said drill stem sub.

31. An elastomeric cartridge subassembly in accordance with claim 20, wherein the central bore of said elastomeric cartridge is cylindrical.

32. An elastomeric cartridge subassembly in accordance with claim 20, wherein the central bore of said elastomeric cartridge is hour-glass shaped.

33. An elastomeric cartridge subassembly in accordance with claim 20, wherein the receiving ends of said elastomeric closure and the insertion ends of said two metallic end pieces are respectively matingly conically tapered.

34. An elastomeric cartridge subassembly in accordance with claim 33, wherein the respective conically tapered ends of said elastomeric closure and said metallic pieces include interlocking grooves.

35. An elastomeric cartridge subassembly in accordance with claim 34, wherein said elastomeric closure is made of material having an elongation capability of 250–700%, a tensile set of 2–20% and a modulus of 700–2700 psi.

* * * * *